United States Patent [19]

Franks, Jr.

[11] 4,234,403

[45] Nov. 18, 1980

[54] ELECTROLYTIC PROCESS FOR THE PRODUCTION OF STANNOUS CHLORIDE PRODUCTS

[75] Inventor: John A. Franks, Jr., Vermilion, Ohio

[73] Assignee: Vulcan Materials Company, Birmingham, Ala.

[21] Appl. No.: 48,829

[22] Filed: Jun. 15, 1979

[51] Int. Cl.[3] ..... B01D 13/02; C25C 1/14

[52] U.S. Cl. ..... 204/180 P; 204/54 R; 204/86; 204/94

[58] Field of Search ..... 204/180 P, 151, 54 R, 204/94, 86, 101, 130

[56] References Cited

U.S. PATENT DOCUMENTS

| | | | |
|---|---|---|---|
| 3,907,653 | 9/1975 | Horn | 204/180 P X |
| 3,926,759 | 12/1975 | Horn et al. | 204/180 P |
| 4,066,518 | 1/1978 | Horn | 204/180 P X |
| 4,147,605 | 4/1979 | Schenker et al. | 204/180 P |

*Primary Examiner*—Arthur C. Prescott

*Attorney, Agent, or Firm*—Burns, Doane, Swecker & Mathis

[57] ABSTRACT

A mixture of stannic and chloride ions having a chloride to tin ratio of at least 4:1 (e.g., stannic anion complexes) is provided to the cathode compartment of an electrolysis cell in which the anode and cathode compartments are separated by a cationic permselective membrane. The anolyte is a mineral acid or tin salt thereof. Operation of the electrolysis cell results in the production of stannous anion complexes which may be treated to obtain stannous chloride products.

14 Claims, 1 Drawing Figure

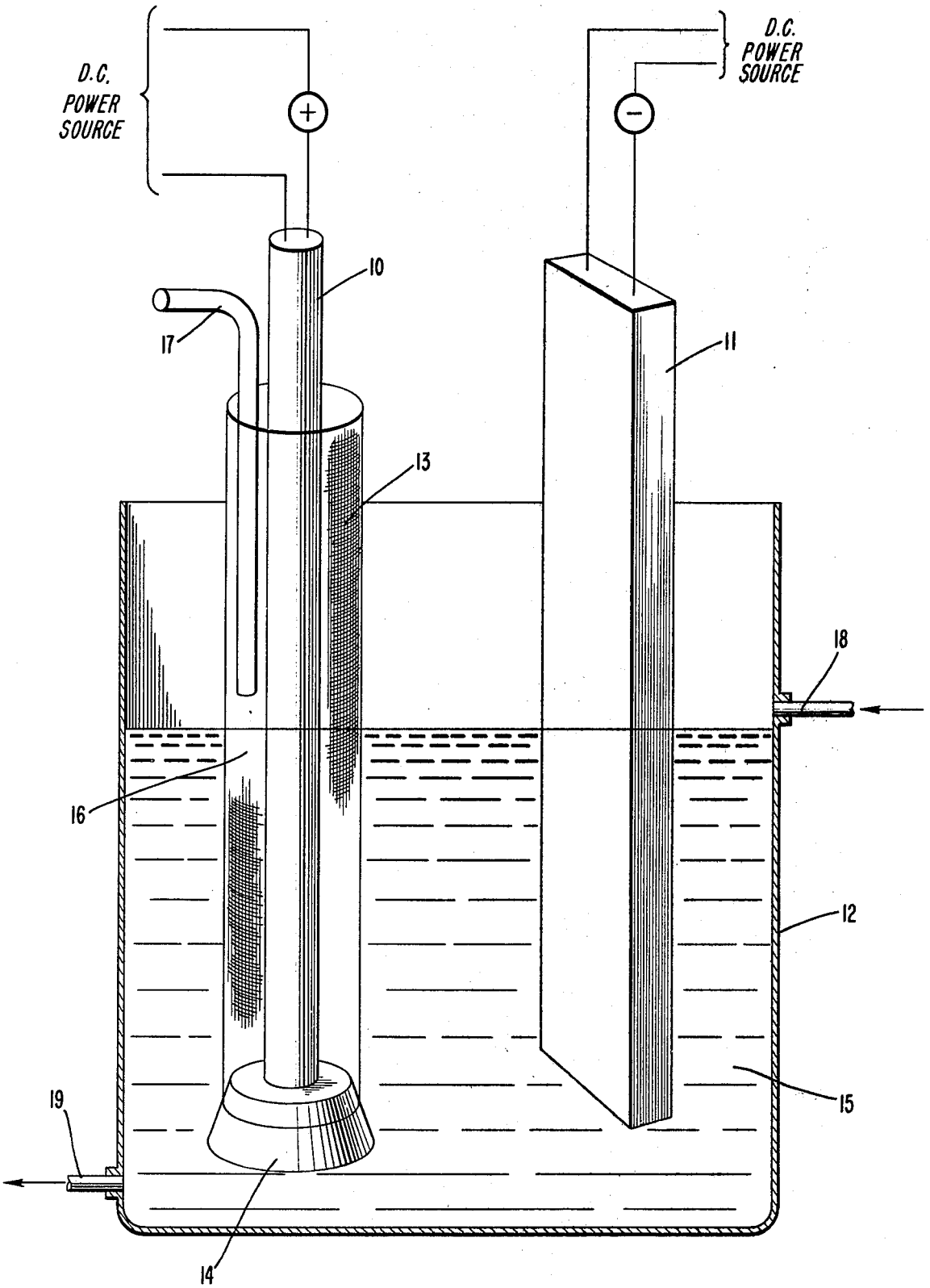
D.C.
POWER
SOURCE
D.C.
POWER
SOURCE
10
11
12
13
14
15
16
17
18
19

ELECTROLYTIC PROCESS FOR THE PRODUCTION OF STANNOUS CHLORIDE PRODUCTS

BACKGROUND OF THE INVENTION

It is known to produce stannous chloride from stannic chloride in a divided cell (divided by an asbestos diaphragm) by introducing a warm stannic chloride solution into the anode compartment of the cell and withdrawing stannous chloride solution from the cathode compartment of the cell. See, for example, U.S. Pat. No. 1,597,653. As disclosed therein, chlorine is evolved at the anode, electrolysis is conducted at temperatures of 70° C. or higher and a portion of the stannic chloride must be retained to prevent deposition of metallic tin.

Electrolytic cells using a porous diaphragm, e.g., an asbestos type diaphragm, permit the flow of electrolyte solution from one electrode compartment to another which flow may cause contamination. In addition, such cells must contend also with the plating of the metal on the cathode which is undesirable from the standpoint of process efficiencies.

In contrast to known fluid permeable membranes, ion permselective membranes, also referred to as ion exchange membranes, have been found useful in a variety of fluid purification applications. One specific use is the demineralization of water. Other specific uses include the treatment of picking liquors to produce sulfuric acid and electrolytic iron, the treatment of copper or leaching solutions to produce hydrochloric acid and copper and the purification of aluminum sulfate solutions by electrolytically depositing iron therefrom. See, Industrial & Engineering Chemistry, Vol. 54, No. 6, page 29 (June 1962) and U.S. Pat. Nos. 3,537,961 and 3,347,761. In addition, cationic permselective membranes have been disclosed for use in processes to produce stannic oxide sol products (see U.S. Pat. No. 3,723,273), anionic permselective membranes have been disclosed for use in a process to form tin and lead salts, e.g., stannous sulfate (see U.S. Pat. No. 3,795,595) and cationic permselective membranes have been suggested for use in the regeneration and recycling of chromium etching solutions. See Chemical Engineering, June 4, 1979, page 77.

Stannous chloride in more recent years has been conventionally prepared by dissolving metallic tin in aqueous hydrochloric acid and evaporating the solution until crystals of the dihydrate $SnCl_2.2H_2O$, commonly known as tin salt, separate. The anhydrous salt can also be made by heating metallic tin in a stream of gaseous hydrogen chloride or by reacting tin metal with chlorine gas in the presence of liquid stannic chloride.

A particularly effective method for preparing stannous chloride is disclosed in U.S. Pat. No. 3,816,602 in which about 1 mol of tin metal, about 1 mol of fuming or essentially anhydrous stannic chloride and at least 4 mols of free water are reacted to produce stannous chloride.

One of the problems with presently available processes for producing stannous chloride is the requirement for the addition of tin metal to reduce the stannic chloride to the stannous chloride form. As tin prices increase, the utilization of such processes results in an increasing cost of the stannous chloride. In addition, the tin metal may contain various metallic impurities (for example, copper, iron, arsenic, antimony or lead) which may deleteriously affect the final product and prevent its utilization in certain end use products and applications. For example, the use of stannous chloride in connection with food additives requires very low tolerences of copper and arsenic. These metal impurities also pose problems in electrotinplating applications.

OBJECTS AND SUMMARY OF THE INVENTION

It is an object of the present invention to provide for the electrolytic production of stannous ion-containing solutions using cationic permselective membranes without incurring or substantially alleviating the problems heretofore associated with the production of such solutions.

Another object of the present invention is to provide an electrolytic process for the production of stannous salts using cationic permselective membranes.

Yet another object of the present invention is to provide an electrolytic process for the production of stannous salts from stannic ion-containing solutions which process requires little or no tin addition.

Still another object of the present invention is to provide an electrolytic process which may be used in a recycle process to provide a stannous salt containing solution from a stannic salt containing solution.

In accordance with one aspect of the present invention there is provided an electrolytic process for the production of stannous salts in an electrolytic cell comprising an anode compartment and a cathode compartment and a cationic permselective barrier between the anode and cathode compartments comprising introducing stannic anions into the cathode compartment of the electrolytic cell, providing an electrolyte in the anode compartment, applying direct current to the anode and cathode to produce stannous anions in the cathode compartment while substantially simultaneously preventing migration of stannous anions between the cathode and anode compartments by maintaining an electrolyte fluid impermeable cationic permselective barrier between the anode and cathode, removing produced gas from the anode compartment and removing the stannous anions from the cathode compartment.

In another embodiment of the present invention there is provided an electrolytic process for the production of stannous chloride utilizing an electrolytic cell comprising a cathode and an anode and an ion permselective barrier dividing the electrolytic cell into anode and cathode compartments which process comprises providing a mixture of stannic and chloride ions having a chloride to tin ratio of at least about 4:1 in the cathode compartment, providing an anolyte solution in the cathode compartment of a mineral acid or tin salt thereof, applying direct current to the anode and cathode to form stannous anions and substantially preventing migration of the stannous anions from the cathode compartment to the anode compartment by maintaining a cationic permselective barrier between the anode and cathode to form a product solution of stannous and chloride ions having a chloride to tin ratio of at least about 2:1 and being substantially free of stannic anions in the cathode compartment, removing produced gases from the anode compartment and recovering a stannous chloride product from the cathode compartment product solution.

It has been found that stannic ion solutions containing an excess of acid moieties form stannic anions in solution which are substantially prevented from passing from the cathode compartment to the anode compartment in the electrolytic cell by the cationic permselective membrane. As the stannous ion is produced in the cathode compartment, further acid moieties are also produced which increase the formation of stannous anion complexes because of the equilibrium constants of the various ions which are produced in the cathode compartment. The equilibrium constants of the various cationic, neutral and anionic complexes which could be present under these circumstances are such as to favor the anionic complexes. The operation of the present process forms further free acid and thus more strongly shifts the equilibrium in favor of the formation of the anionic complexes. In addition, it has been found that it is necessary to remove the gases which are produced in the anolyte solution during the reaction to prevent their resolublization and the concommitant re-oxidation of the stannous anions to stannic anions. The catholyte solution containing stannous anions can be easily treated to remove the desired stannous salt product (such as stannous chloride which can be in the ultimate recovered form of stannous chloride dihydrate, anhydrous stannous chloride or a stannous chloride solution containing some excess acid—the latter being apparently in the form of a complexed chlorostannous acid such as $HSnCl_3$, $H_2SnCl_4$ or mixtures thereof). The process of the present invention can be used to convert at least 90, preferably at least 95, most preferably at least 98, percent of the stannic anions to stannous anions.

BRIEF DESCRIPTION OF THE FIGURE

The FIGURE is a schematic representation of an electrolytic cell used in the process of the present invention.

DESCRIPTION OF THE PREFERRED EMBODIMENTS

The FIGURE shows a representation of an electrolytic cell which may be utilized in the process of the present invention. This cell comprises an anode 10 and a cathode 11 within an electrolytic cell 12. A cationic permselective membrane 13 is disposed about the anode 10 to separate the anode and cathode compartments of the electrolytic cell 12. The cationic permselective membrane 13 extends generally along the length of the anode 10. At the bottom thereof a closure 14 seals the bottom of the anode compartment. The cathode compartment of the electrolytic cell 12 contains a catholyte solution 15 which initially contains the stannic anion solution as further described hereinafter. The anode compartment of the electrolytic cell 12 contains an anolyte solution 16 which can be of any suitable, non-deleterious acid or acid salt electrolyte solution as also further described hereinafter. The anode compartment further contains a vacuum tube 17 or other means for removing gases which are produced within the anolyte compartment during the operation thereof. If desired, the electrolytic cell 12 can also contain a stirrer or other means for agitating the solution (not shown) and a thermocouple for obtaining the temperature of the solution (not shown). The electrolytic cell also contains suitable connections 18 and 19 for the addition of and removal of the catholyte solution 15 from the electrolytic cell 12.

The anode 10 and cathode 11 are connected to a suitable source of direct current power source at their terminals. Heating or cooling means may also be provided to maintain the anolyte and the catholyte at the desired operating temperatures.

The anode and cathode may be of any convenient shape such as a sheet or rod and the overall size of the anode, the cathode and the respective compartments may be varied according to the particular style of operation although it may be advantageous in certain instances to have the cathode larger, e.g., up to about 3 or more times the size, of the anode. Any type of anode and cathode material that is electrically conductive and has low reactivity in electrolyte solution, i.e., is substantially inert to the electrolyte, may be used. For example, carbon has been found to be suitable. Other suitable materials may also be utilized. In certain embodiments of the present invention as described hereinbelow, it may also be possible to utilize an anode of a material which is reactive with the anolyte solution to form a particular salt in the anolyte.

Multiple cell operations, i.e., anode compartments interposed between cathode compartments, may also be utilized.

The electrolytic cell may be operated at anode current densities at from about 5 to 200 or more amperes per square foot of anode area (the upper limit being determined generally by the upper limit of the value of the current density permitted by the particular cationic permselective membrane utilized) and at cell voltages ranging from about 1 to 20, preferably from about 1 to about 10, volts.

The temperature of the anolyte may be from about 5° C. up to about 75° C. but more typically is about 10° C. to about 60° C., preferably from about 15° C. to 55° C. Again, the maximum permissable temperature may vary according to the particular cationic permselective membrane utilized. The temperature of the catholyte may fall within the same range as given for the anolyte and preferably is within about 5° C. of the anolyte temperature.

The anolyte, i.e., the electrolyte in the anode compartment, may be any aqueous solution of a compatible electrolyte material. Typically, the anolyte will be a mineral acid solution or a tin salt thereof. A limitation on the utilization of a material as the anolyte arises from two factors. That is, as described hereinbelow, the utilization of a particular material generally results in the production of an oxidizing gas which must be removed from the electrolytic cell during processing in order to achieve the desired results. The toxicity of the produced gas and/or economics of the overall process may dictate the utilization of a particular material as the anolyte. For example, the use of nitric acid may result in the production of gaseous nitrous oxides in the anode compartment which are toxic and difficult to control. Thus, the utilization of nitric acid is not normally preferred unless such gaseous by-products are desired for other purposes. In another instance, the utilization of hydrochloric acid as the electrolyte will result in the production of chlorine gas in the anode compartment which gas while also toxic may be useful in certain processes for other purposes. Thus, hydrochloric acid may be more acceptable economically as the anolyte material. Hydrohalous acids are one of the preferred groups of anolyte electrolyte materials. Sulphuric acid may also be utilized as the anolyte and in such case oxygen will be the produced gas. Since oxygen presents no toxicity problems, sulphuric acid is one of the other preferred embodiments of the presently claimed invention. Tin salts of any suitable acid may also be used. While other metallic salts of these acids are theoretically utilizable, the presence of other metallic cations in the anode compartment could result in the transference of these other metal cations into the cathode compartment and thus into the stannous salt solutions being produced therein. Ordinarily, these other metal cations are not desired in the stannous salt solutions. It is thus preferred that when metal salts are used in the anolyte, that the stannous salts of these particular acids be utilized. Typically, the concentration of the acid or salt solution ranges from about 2 to about 50% free acid or salt by weight of the anolyte solution.

The catholyte, i.e., the electrolyte in the cathode compartment, may be any aqueous solution containing stannic anions. In the case of stannic anion-containing solutions which are available from various commercial processes (e.g., acid plating baths or the like) the solution contains an excess of acid relative to the amount necessary to form the stannic acid salt. For example, stannic chloride has the typical formula $SnCl_4$. In commercial stannic chloride manufacturing processes (other than those for the production of anhydrous stannic chloride) a small amount of excess hydrochloric acid is generally added to stabilize stannic chloride such that the ratio of chlorine to tin in the stannic chloride solution is greater than 4, generally about 4.5 to 1. In certain chemical processes (e.g., acid plating baths or the like), the ratio of chlorine to tin in the stannic chloride-containing solutions may be as high as about 6 to 1 or higher. It has been found that under such circumstances when the chlorine is present in excess amount that the tin and chloride ions form anionic complexes, e.g., $SnCl_6^=$ or $SnCl_5^-$. These complexes may also be considered as $SnCl_4.2HCl$ or $SnCl_4.HCl$, respectively. While the exact nature of these components has not been conclusively established, it has been found that, under these circumstances, the tin and chloride ions act as anionic complexes in solution in the electrolysis process of the present invention. Even if a stoichiometric stannic chloride solution is available, hydrochloric acid may be added thereto to obtain the desired ratio of chlorine to tin greater than 4 to 1.

Often, the anolyte feed stocks which may be utilized in the electrolysis process of the present invention are those which have been produced in various other chemical processes and which may contain minor and/or substantial amounts of various impurities. In such cases, it is generally desirable to remove these impurities prior to introduction into the anode compartment by various purification techniques including oxidation (for example, by contact with oxygen or chlorine gases) or by contact of the solution with various adsorbents or ion exchange materials to remove specific impurities contained therein. It may also be desirable to concentrate the solution prior to introduction into the electrolysis cell, for example, to a concentration up to about 60% of stannic chloride by weight of the solution.

In general, any type of cation permselective membrane may be used which will substantially exclude or prevent tin anions from passing from the anode compartment to the cathode compartment of the electrolytic cell, but which will allow passage of cations therethrough.

Typically, the cation permselective membrane is a cation exchange membrane or sheet which is substantially impermeable to the aqueous electrolyte. These cation exchange membranes are well known per se and include both membranes where ion exchange groups or material are impregnated in or distributed throughout a polymeric matrix or binder, as well as those where such groups are associated only with the outer surface of a membrane backing or reinforcing fabric. Continuous ion exchange membranes, in which the entire membrane structure has ion-exchange characteristics and which may be formed by molding or casting a partially polymerized ion exchange resin into sheet form, may also be used.

For example, the ion exchange material may include material to which acid groups such as $—SO_3H$ or —COOH are added to a polystyrene resin by conventional procedures. In the alternative, the groups may be added by contacting the surface to be coated with a reactant, the molecular structure of which leaves exposed to the surface thereof ion exchange groups of the same type as those found upon the surfaces of cation exchange membranes, e.g., $—SO_3H$ or —COOH moieties.

Widely known cation exchange membranes may be prepared by copolymerizing a mixture of ingredients, one of which contains a substituent or group which is acid in nature and which may comprise the sulfonic acid group or the carboxylic acid group. Thus, this ionizable group may be attached to a polymeric compound such as copolymers of styrene and divinyl benzene, polystyrene phenolaldehyde resins, resorcinol-aldehyde polymers, copolymers of divinyl benzene with acrylic acid, copolymers of divinyl benzene with maleic anhydride, copolymers of divinyl benzene with acrylonitrile, copolymers of divinyl benzene and methacrylic acid, cellulose derivatives such as regenerated cellulose, ethyl cellulose and polyvinyl alcohol, and like polymers containing free hydroxyl groups, which are reacted with sulfonating agents, and polyethylene reacted with chlorosulfonic acids or other sulfonating agents.

The preparation of these cation exchange membranes are well known in the art and for sake of brevity are not further described herein; for more detailed information, reference may be made to U.S. Pat. Nos. 2,681,320, 2,723,229, 2,832,728, 3,113,911, 3,356,607 and 3,480,495, all of which are incorporated herein by reference.

Typically, these ion exchange membranes are reinforced, i.e., have a backing consisting of a sheet of a relatively inert material, as for example, glass having a woven or mesh structure. Other known backings include woven and non-woven fabrics of materials such as asbestos, polyesters, polyamides, acrylics, modacrylics, ceramic or glass fibers, vinylidene chloride, rayons, polypropylene, polytetrafluoroethylene and the like. Fabrics or backings made of mixtures of two or more of these materials may also be used in the present invention.

The thickness of the cation permselective membrane is not particularly critical, but will of course depend on the particular operating conditions. In general, suitable membranes may be as thin as 20,000th of an inch to as much as ½ inch thick. The minimum thickness of a membrane will also depend on the total thickness of the supporting structure. Although the thicker membranes have a longer useful life, their electrical resistances increase proportionally to their thickness, so that if the membrane is made increasingly thicker, a value will be obtained for which the resistance is too great for practical use.

Typical commercially available cation exchange membranes include those available from Ionics Incorporated, Watertown, Mass.; from Ionac Chemical Company, Birmingham, N.J., under the trade name "Ionac"; from AMF Incorporated of New York, N.Y., under the trade name "AMFion" and from E. I. duPont de Nemours & Co. (Inc.) under the trade name "Nafion."

The present process may be conducted on a batch, semi-continuous or continuous basis and at atmospheric, super-atmospheric or sub-atmospheric pressures but typically is run at atmospheric pressure. The present invention is particularly useful in the recycling of stannous chloride streams used in commercial processes which produce stannic chloride streams as a result of a particular treatment. In this manner, a regeneration or replenishment of the stannous chloride streams may be affected with a minimum addition of tin (although tin or stannous chloride may be added to the stream as make up in appropriate situations).

When hydrochloric acid is utilized as the anolyte solution, chlorine gas is liberated at the anode. In order to prevent the chlorine (a known strong oxidizer) from oxidizing the stannous anions to stannic anions, it is necessary to remove the chlorine gas which is evolved. For this purpose, a vacuum tube or other means are provided in the anode compartment as described before. When sulphuric acid is utilized as the anolyte medium, oxygen gas is involved which again must be removed to prevent the oxidation of the stannous anions to stannic anions. The particular gas which is evolved will depend on the particular electrolyte material which is used in the anolyte and the choice of the electrolyte material will depend upon the utilization of the process and the type of by-product gas which is desired or which poses the least amount of problems for collection and disposal. Different anolyte materials may be used to effectuate the production of different gases.

It is also possible to utilize the anolyte compartment to manufacture a tin chemical other than that being produced in the cathode compartment. That is, when stannous chloride-hydrochloric acid anionic complexes are being formed in the cathode compartment, it is possible to produce stannous sulfate in the anode compartment using sulfuric acid as the anolyte and a soluble tin electrode. In such a process, means to remove the anolyte material and replenish the soluble electrode during operation may be provided or the process may be conducted as a batch process with removal of the anolyte and catholyte solutions after the anode has been completely dissolved. Other tin chemicals may be manufactured in the anolyte solution in the same manner by the appropriate selection of the electrolyte of the anode compartment.

It is possible that during the operation of the process of the present invention tin crystals may be formed on the cathode. By appropriate control of the temperature and current densities within the ranges given above, these tin crystals should be completely redissolved in the catholyte solution.

Alternatively, the solution may be left in the electrolysis cell after the current has been terminated to dissolve the tin crystals in the solution. Generally, this dissolution period (or "steep") period is of a relatively short (e.g., a few hours or less) duration.

The present invention is further illustrated by the following Examples: All parts, percentages and ratios in the examples, as well as in other parts of the specification and claims are by weight unless otherwise specified.

EXAMPLE I

A solution having the following parameters was electrolytically reduced at three different amperages, each amperage being held constant during the indicated time interval to establish an overall reduction rate for each respective current value. Carbon electrode rods were employed for the cathode and anode. The submerged area of each was 14 $cm^2$. The cathode to anode ratio was 1 and the membrane to cathode ratio was 3. The anolyte used was 2 N HCl. The catholyte contained 150 milliliters tin (stannic) chloride solution.

TABLE 1

Starting Solution Data:

| | | | |
|---|---|---|---|
| Total tin | = | 176.7 g/l | |
| Stannous tin | = | 0 | |
| Molar ratio Cl/Sn | = | 5.9 | |
| Solution density | = | 1.31 | 72° F. |

Electrolysis Data:

| Run Interval | Amps | Cathode Current Density, Amp/$ft^2$ | Cell Potential, Volts | Electrolysis Time, Hours | Electrolysis Temperature, Degrees F. |
|---|---|---|---|---|---|
| A | 0.3 | 21 | 1.9 | 1.0 | room |
| B | 2.0 | 132 | 3.3 | 1.0 | room |
| C | 3.0 | 200 | 3.9 | 1.5 | 100–115 |

Production and Rate Data:

| Run Interval | $Sn^{+2}$ Produced Interval, g/l | $Sn^{+2}$ Produced Total, g/l | Rate of Production $Sn^{+2}$/Interval, g/l/hr |
|---|---|---|---|
| A | 3.0 | 3.0 | 3.0 |
| B | 25.1 | 28.1 | 25.1 |
| C | 61.5 | 89.6 | 41.0 |

At the end of Run Interval A (electrolysis at 0.3 amps for 1 hour), the solution is allowed to remain with agitation (or steep) for about 5 to 10 minutes. There is no visual observation of any tin crystals on the cathode before or after the steep. A similar agitation (or steep) time is provided after Run Interval B (2.0 amps at 1 hour electrolysis). Following Run Interval C (3.0 amps for 1½ hours at the 100°–115° F. temperature), tin crystals are visually observed on the cathode. The solution is agitated in the absence of electrolysis for 3 hours at 110° F. to completely dissolve all the tin crystals formed. The values for the stannous tin formed in the solution for each interval is measured after the steep time in each instance. This data not only shows that the electrolysis as performed in accordance with the present invention will reduce stannic anions to stannous anions, it further demonstrates that the rate of production increases with increasing current density.

EXAMPLE II

A similar but more dilute solution as used in Example I is utilized using the same sample volumes, electrodes, membrane and anolyte solution as in Example I. The solution is electrolytically reduced for 1 hour at 3 amps (200 amps/$ft^2$ cathode current density and 3.2 volts cell potential) at 100°–110° F. followed by a steep for 1 hour at 100° F. to dissolve observed tin crystals. The total tin in grams per liter at that point is measured at 147.7 g/l and the production of $Sn^{+2}$ from $Sn^{+4}$ in this first interval is 42.1 g/l/hr. The solution is then further electrolytically reduced at the same electrical values at a temperature of 100°–105° F. and is also held for the same steep time and temperature. At the end of the second electrolysis interval, the total tin is measured as 143.9 g/l and the production of $Sn^{+2}$ is 39.4 g/l/hr.

In both this Example as well as in Example I, chlorine gas is evolved at the anode. During the total run, additional 2 N HCl is added to the anolyte solution to maintain the anolyte solution level at a relatively constant volume.

It is noted that in this Example the total tin and the rate of $Sn^{+2}$ production is reduced during the second interval of the process (although further $Sn^{+2}$ was produced in this second electrolysis interval). While the reason for this reduction is not known, it is possible that water may have been transferred through the cationic permselective membrane from the anode compartment into the cathode compartment (thus reducing the total amount of tin in terms of the g/l) and/or that a certain amount of $Sn^{+2}$ in discrete form (that is, not in an anionic complex) is formed and transferred across the permselective membrane into the anolyte. No measurements are made of the final anolyte solutions in Example I and II to determine whether any tin was present therein.

EXAMPLE III

The procedures of the previous Examples are repeated except that a 6 N sulfuric acid anolyte is utilized. The cathode to anode ratio was 3 and the membrane to cathode ratio was 1.2. The cathode area submerged in the catholyte was 35 $cm^2$ and the charge to the cathode compartment was 300 ml of solution. 25 ml of 6 N sulfuric acid was used in the anolyte compartment. The catholyte starting solution contains about 193 g/l of total tin, all of which is in the stannic form. The electrolysis data is shown in Table 2 and the production and rate data (in terms of total tin, total stannous tin, and rate of production of stannous tin) is shown in Table 3. In each instance, a steep is performed as indicated in Table 3 to completely dissolve any tin crystals which are observed on the cathode. If no tin crystals are observed, no steep is performed.

By the end of the electrolysis 99.5% of the tin in solution was in the stannous form.

TABLE 2

| Run Interval | Amps. | Volts | Electrolysis Time | Amp. Hrs. | Current Density | Electrolysis Temperature |
|---|---|---|---|---|---|---|
| A | 3.0 | 3.4 | 1 hr | 3 | 79.6 amps/$ft^2$ | 105°-112° F. |
| B | 6.0 | 3.5 | 1 hr | 6 | 159.3 amps/$ft^2$ | 110°-120° F. |
| C | 6.0 | 3.8 | ½ hr | 3 | 159.3 amps/$ft^2$ | 100° F. |
| D | 9.5-10 | 5.0 | 1 hr | 9.5-10 | 252-265 amps/$ft^2$ (ave. = 259) | 105°-130° F. |
| E | 6.0 | 3.8 | 1 hr | 6.0 | 159.3 amps/$ft^2$ | 110° F. |
| F | 6.0 | 3.8 | 11 min | 1.10 | 159.3 amps/$ft^2$ | 90°-100° F. |
| | | | | 28.6 | | |

TABLE 3

| Run Interval | Total Tin, g/l | Total Stannous Tin, g/l | Steep Time | Steep Temp. | % Steep | Rate of Production $Sn^{+2}$/Interval, g/l/hr. |
|---|---|---|---|---|---|---|
| A | 193.0 | 18.2 | None | — | — | 18.2 |
| B | 198.6 | 59.0 | 15 min. | 120°-115° F. | 100% | 40.8 |
| C | — | 81.05 | — | — | 100% | 22.0 |
| D | 201.5 | 152.9 | 1 hr. | 130°-115° F. | 100% | 71.9 |
| E | 209.0 | 200.3 | Overnight | Room Temp. | 100% | 47.4 |
| F | 215.3 | 214.2 | Overnight | Room Temp. | 100% | — |

The catholyte solution from the above electrolytic process is conveyed to a concentrator which is a conventional vacuum concentration apparatus in which both the water and hydrochloric acid content are reduced to obtain a stannous chloride solution which contains a slight excess of hydrochloric acid (about 20% in excess of the chlorine necessary for stoichiometric stannous chloride). The final solution contains sufficient excess acid to theoretically form the compound $SnCl_2.HCl$.

This product may be then utilized in various commercial processes in which stannous chloride is normally employed with particularly efficacious results.

The overall current efficiency for the process of this Example was 90%.

COMPARATIVE EXAMPLE

A feed solution containing 368.7 g/l of total tin with a mole ratio of Cl/Sn of 5.02 (and zero measured amount of $Sn^{+2}$) is introduced into an electrolytic cell having two carbon electrodes and no cationic permselective membrane. The anode cathode areas submerged in solution is 32.5 $cm^2$.

The solution is subjected to electrolysis at a constant 4 amps and a voltage varying from 4.5 to 3.2 volts and a temperature of 75° to 100° F. for one hour. The solution is then steeped for 15 minutes at about 100° F. Analysis of the resulting solution shows the production of 3.25 gm/l of stannous tin which is a current efficiency of 36.8%.

This solution is then subjected to one hour further electrolysis time at a constant 2 amps, temperature of between 75° to 85° F. and 2.34 volts. Again, the solution is steeped for 15 minutes at about 80° F. after electrolysis. Analysis of the solution showed that 3.37 gm/l of stannous tin forms which is a difference of 0.12 gms from that in the solution which was used at the starting of this portion of the electrolysis. The percent current efficiency for this portion of the electrolysis is 2.8%.

The resulting solution is then subjected to a further electrolysis at a constant 7 amps, 4.35 to 3.9 volts at 85° to 115° F. for one hour with 30 minutes steep time. Analysis of the resulting solution shows 3.76 gm/l of stannous tin which is an increase of 0.39 gm/l which converts to a process efficiency of 2.5%.

The principles, preferred embodiments and modes of operation of the present invention have been described in the foregoing specification. The invention which is intended to be protected herein however is not to be construed as limited to the particular forms disclosed, since these are to be regarded as illustrative rather than restrictive. Variations and changes may be made by those skilled in the art without departing from the spirit of the present invention.

I claim:

1. An electrolytic process for the production of stannous salts in an electrolytic cell, comprising an anode compartment and a cathode compartment and a cationic permselective barrier between the anode and cathode compartments comprising introducing stannic anions into the cathode compartment of the electrolytic cell, providing an electrolyte in the anode compartment, applying direct current to the anode and cathode to produce stannous ions in the cathode compartment while substantially simultaneously preventing migration of stannous anions between the cathode and anode compartments by maintaining an electrolyte fluid impermeable cationic permselective barrier between the anode and cathode, removing produced gas from the anode compartment and removing the stannous ions from the cathode compartment.

2. A process of claim 1 in which the electrolyte in the anode is a mineral acid or stannous salt thereof.

3. A process of claim 2 wherein the mineral acid is hydrochloric or sulfuric acid.

4. The process of claim 1 in which the stannic anions are introduced into the cathode compartment of the electrolytic cell in conjunction with chlorine ions.

5. The process of claim 4 wherein the ratio of chlorine ions to tin ions in the material introduced into the cathode compartment of the electrolytic cell is at least about 4 to 1.

6. A process of claim 1 in which the anode and cathode are of inert materials.

7. The process of claim 6 wherein the anode and cathode are each formed of carbon.

8. A process of claim 1 wherein the anode is formed of tin.

9. An electrolytic process for the production of stannous chloride utilizing an electrolytic cell comprising a cathode and an anode and an ion permselective barrier dividing the electrolytic cell into anode and cathode compartments which process comprises providing a mixture of stannic and chloride ions having a chloride to tin ratio of at least about 4:1 in the cathode compartment, providing an anolyte solution in the cathode compartment of a mineral acid or tin salt thereof, applying direct current to the anode and cathode to form stannous ions and substantially preventing migration of the stannous ions from the cathode compartment to the anode compartment by maintaining a cationic permselective barrier between the anode and cathode to form a product solution of stannous and chloride ions having a chloride to tin ratio of at least about 2:1 and being substantially free of stannic anions in the cathode compartment, removing produced gases from the anode compartment and recovering a stannous chloride product solution from the cathode compartment product solution.

10. The process of claim 9 wherein the stannous chloride product solution is recovered by concentration of the cathode compartment product solution.

11. The process of claim 9 wherein the anolyte solution is hydrochloric acid or sulfuric acid.

12. The process of claim 11 wherein the anolyte solution is hydrochloric acid.

13. The process of claim 11 wherein the anolyte solution is sulfuric acid.

14. The process of claim 9 wherein the mixture of stannic and chloride ions having a chloride to tin ratio of at least about 4:1 is produced by the oxidation of stannous chloride.

* * * * *